US008061314B2

(12) United States Patent
Ezaki

(10) Patent No.: US 8,061,314 B2
(45) Date of Patent: Nov. 22, 2011

(54) INTERNAL COMBUSTION ENGINE VALVE MECHANISM

(75) Inventor: Shuichi Ezaki, Susono (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 504 days.

(21) Appl. No.: 12/376,788

(22) PCT Filed: Oct. 18, 2007

(86) PCT No.: PCT/JP2007/070766

§ 371 (c)(1),
(2), (4) Date: Feb. 9, 2009

(87) PCT Pub. No.: WO2008/050817

PCT Pub. Date: May 2, 2008

(65) Prior Publication Data

US 2010/0186693 A1 Jul. 29, 2010

(30) Foreign Application Priority Data

Oct. 24, 2006 (JP) ..... 2006-288891

(51) Int. Cl.
*F01L 1/34* (2006.01)

(52) U.S. Cl. ..... 123/90.16; 123/90.39; 123/90.44; 123/90.45; 74/559; 74/569

(58) Field of Classification Search ..... 123/90.16, 123/90.39, 90.43, 90.44, 90.45; 74/559, 74/567, 569
See application file for complete search history.

(56) References Cited

U.S. PATENT DOCUMENTS

| | | | | |
|---|---|---|---|---|
| 7,246,578 | B2 * | 7/2007 | Nakamura et al. | 123/90.16 |
| 2005/0178350 | A1 | 8/2005 | Nakamura et al. | |
| 2006/0219196 | A1 | 10/2006 | Asada et al. | |

FOREIGN PATENT DOCUMENTS

| | | |
|---|---|---|
| JP | 3 239712 | 10/1991 |
| JP | 2003 239712 | 8/2003 |
| WO | 03 095805 | 11/2003 |
| WO | 2005 059321 | 6/2005 |

* cited by examiner

*Primary Examiner* — Ching Chang
(74) *Attorney, Agent, or Firm* — Oblon, Spivak, McClelland, Maier & Neustadt, L.L.P.

(57) ABSTRACT

An internal combustion engine valve mechanism including a rocker arm, which includes a bearing section and a rocker roller, and an HLA. The HLA has a pivot, which is to be inserted into the bearing section, and supports one end of the rocker arm. The pivot has a spherically curved surface, whereas the bearing section has a shell-shaped dent. A swing arm rotates in synchronism with camshaft rotation and gives roller pressure force to the rocker roller. The direction in which the swing arm presses the rocker roller shifts toward the HLA when the lift of a valve disc increases. An osculating circle is inclined by inclining the axis of the bearing section at an angle of α° relative to the axis of the HLA.

19 Claims, 12 Drawing Sheets

INTERNAL COMBUSTION ENGINE VALVE MECHANISM

TECHNICAL FIELD

The present invention relates to an internal combustion engine valve mechanism, and more particularly to a valve mechanism having such a structure that the direction of force applied to a rocker roller attached to a rocker arm varies with the lift amount of a valve disc.

BACKGROUND ART

A known valve mechanism disclosed, for instance, by Japanese Patent JP-A-2003-239712 uses a rocker arm having a rocker roller to drive a valve disc. In this conventional valve mechanism, the rocker arm has a bearing section at one of its ends and is in contact with the valve disc at the other end. The rocker roller is positioned between these two ends.

A lash adjuster has a pivot at its leading end. The pivot is pivotally supported by a bearing of the rocker arm. When the rocker roller is pressed, the configuration described above causes the rocker arm to turn on the pivot, thereby pushing the valve disc in a valve opening direction. Therefore, when the rocker roller periodically swings, the valve disc can be periodically opened/closed.

In the conventional valve mechanism described above, a variable valve mechanism is positioned over the rocker roller. The variable valve mechanism includes a swing arm, which is in contact with the rocker roller, and a conversion mechanism, which is positioned between the swing arm and a camshaft. The conversion mechanism is capable of converting the rotary motion of the camshaft to a swinging motion of the swing arm and changing a basic posture of the swing arm in accordance with external instructions.

When the basic posture of the swing arm changes, a change occurs in the swing angle between the swing start position at which swing arm operation is started and the pressure start position at which the swing arm starts to push the rocker roller. When the swing angle changes, a maximum displacement amount of the rocker roller changes, as a result, a maximum lift amount of the valve disc changes. In this manner, the conventional valve mechanism described above can change the maximum lift amount of the valve disc.

With regard to the present invention, the applicant is aware of the following document as a related art.

[Patent Document 1] Japanese Patent JP-A-2003-239712

DISCLOSURE OF INVENTION

Problem to be Solved by the Invention

It may be demanded that a great lift amount be given to the valve disc of an internal combustion engine. Particularly, an internal combustion engine having a variable valve mechanism can generate a sufficiently great lift without being limited by a request for a small lift, because it can freely vary the lift amount. Therefore, a particularly great maximum lift may be set for such an internal combustion engine.

In the aforementioned conventional valve mechanism, the position at which the rocker roller comes into contact with the swing arm is not fixed. It varies with the swing angle of the swing arm. If, for instance, the rocker roller is in constant with the swing arm directly above the rotation center, the force input from the swing arm to the rocker roller constantly presses the rocker arm downward. However, if the position at which the rocker roller is in contact with the swing arm is shifted laterally from a position directly above the rotation center, the force input from the swing arm to the rocker roller includes a component for pressing the rocker arm in a lateral direction (lateral component) in addition to a component for pressing the rocker arm downward.

The greater the lift amount required of the valve disc, the more likely the position at which the rocker roller comes into contact with the swing arm will shift laterally from a position directly above the rocker roller. Therefore, the greater the lift amount, the more likely a great lateral component will be input to the rocker roller.

The force input to the rocker roller is transmitted as the force for pressing the bearing section of the rocker arm against the pivot of the lash adjuster. The lateral component included in the force input to the rocker roller laterally presses the bearing section toward the pivot. The surface of the pivot is spherically curved. Therefore, when a strong lateral force is applied to the bearing section, the bearing section may become displaced along the spherically curved surface of the pivot, rise above the pivot, and leave the pivot.

The conventional valve mechanism is not designed to handle the above situation. More specifically, if an attempt is made to further increase the lift amount, the conventional valve mechanism cannot prevent the bearing section from rising above and coming off. As such being the case, it is difficult for the conventional valve mechanism to satisfy a demand for further lift amount increase.

The present invention has been made to solve the above problem. An object of the present invention is to provide an internal combustion engine valve mechanism that is capable of giving a sufficiently great lift amount to the valve disc and properly preventing the bearing section of the rocker arm from rising above the pivot of the lash adjuster.

The above object is achieved by an internal combustion engine valve mechanism according to a first aspect of the present invention. The valve mechanism includes a rocker arm that has a bearing section at one end and a rocker roller at the center region; a lash adjuster that has a pivot, which is to be inserted into the bearing section, and supports one end of the rocker arm; a valve disc that contacts with the other end of the rocker arm; and a transmission member that operates periodically in synchronism with the rotation of a camshaft to periodically press the rocker roller. The direction of roller pressure force applied to the rocker roller from the transmission member varies with the lift amount of the valve disc. The bearing section and the pivot have different curvatures so that the contact between the bearing section and the pivot forms an osculating circle. The axis of the osculating circle prevailing in a zero lift state is inclined toward a maximum force transmission point, which transmits greater force than any other point on the osculating circle prevailing in a maximum lift state, in relation to the axis of the lash adjuster.

In a second aspect of the present invention, an internal combustion engine valve mechanism includes a rocker arm that has a bearing section at one end and a rocker roller at the center; a lash adjuster that has a pivot, which is to be inserted into the bearing section, and supports one end of the rocker arm; a valve disc that contacts with the other end of the rocker arm; and a transmission member that operates periodically in synchronism with the rotation of a camshaft to periodically press the rocker roller. The direction of roller pressure force applied to the rocker roller from the transmission member varies with the lift amount of the valve disc. The bearing section and the pivot have different curvatures so that the contact between the bearing section and the pivot forms an osculating circle. The axis of the osculating circle prevailing in a zero lift state is inclined toward a maximum force transmission point, which transmits greater force than any other point on the osculating circle prevailing in a maximum lift state, in relation to the direction of the roller pressure force in the zero lift state.

In a third aspect of the present invention, an internal combustion engine valve mechanism includes a rocker arm that has a bearing section at one end and a rocker roller at the center; a lash adjuster that has a pivot, which is to be inserted into the bearing section, and supports one end of the rocker arm; a valve disc that contacts with the other end of the rocker arm; and a transmission member that operates periodically in synchronism with the rotation of a camshaft to periodically press the rocker roller. The direction of roller pressure force applied to the rocker roller from the transmission member varies with the lift amount of the valve disc. The bearing section and the pivot have different curvatures so that the contact between the bearing section and the pivot forms an osculating circle. The axis of the osculating circle prevailing in a zero lift state is inclined toward a maximum force transmission point, which transmits greater force than any other point on the osculating circle prevailing in a maximum lift state, in relation to the axis of the valve disc.

In a fourth aspect of the present invention, the axis of the lash adjuster may be parallel to the direction of the roller pressure force in a zero lift state.

In a fifth aspect of the present invention, the axis of the lash adjuster may be parallel to the axis of the valve disc.

In a sixth aspect of the present invention, the pivot may have a spherically curved surface that is in contact with the bearing section. Further, the bearing section may be a shell-shaped dent having a curved surface that is in contact with the pivot and has a larger curvature radius than the spherically curved surface. The axis of the bearing section may have an inclination that should be satisfied by the axis of the osculating circle.

In a seventh aspect of the present invention, the transmission member may be configured so that the contact position between the transmission member and the rocker roller moves on the rocker roller toward the lash adjuster as the lift amount of the valve disc increases. Further, the inclination of the osculating circle is set so, that the force transmitted from the bearing section to the pivot at the maximum force transmission point in a maximum lift state is directed toward a main body of the lash adjuster in relation to the center of the spherically curved surface.

In an eighth aspect of the present invention, the transmission member may be configured so that the contact position between the transmission member and the rocker roller moves on the rocker roller toward the valve disc as the lift amount of the valve disc increases. Further, the inclination of the osculating circle may be set so that the force applied in a zero lift state to a maximum force transmission point, which transmits greater force than any other point on the osculating circle prevailing in a zero lift state, is directed toward a main body of the lash adjuster in relation to the center of the spherically curved surface.

In a ninth aspect of the present invention, the bearing section may be a dent having a spherically curved surface that is in contact with the pivot. Further, the pivot may have, at a section for insertion into the bearing section, a shape that is obtained by circularly cutting a part of a spherically curved surface having a smaller curvature radius than the spherically curved surface of the bearing section. The axis of the circularly cut portion may have an inclination that should be satisfied by the axis of the osculating circle.

In a tenth aspect of the present invention, the inclination of the circularly cut portion may be set so that the force transmitted from the bearing section to the pivot at the maximum force transmission point in a maximum lift state is directed toward a main body of the lash adjuster in relation to the center of the spherically curved surface.

In a eleventh aspect of the present invention, the valve mechanism according to any one of the first through tenth aspects of the present invention may further includes a control shaft that functions as a rotation center shaft of the transmission member; a base rotation position change mechanism for changing a base rotation position of the transmission member in a zero lift state in accordance with the position of the control shaft; and a cam operation conversion mechanism for converting the motion of a cam included in the camshaft to a swing of the transmission member, which begins at the base rotation position. A line connecting the center of the control shaft to the center of the rocker roller may be parallel to the axis of the lash adjuster.

According to the first aspect of the present invention, the bearing section of the rocker arm and the pivot of the lash adjuster come into contact with each other on the osculating circle. Therefore, the force input from the transmission member to the rocker roller is transmitted from the bearing section to the pivot via the osculating circle. The valve mechanism according to the present invention is such that the axis of the osculating circle prevailing in a zero lift state is inclined toward a maximum force transmission point in relation to the axis of the lash adjuster. The maximum force transmission point transmits greater force than any other point on the osculating circle in a maximum lift state. When the degree of inclination of the axis of the osculating circle toward the maximum force transmission point increases, the degree of parallelism between the direction of force applied to the maximum force transmission point and the axis of the osculating circle increases. The higher the degree of parallelism between the direction of force applied to the maximum force transmission point and the axis of the osculating circle, the less likely the bearing section will rise above the pivot. Therefore, even when a sufficiently great maximum lift amount is to be generated, the present invention can effectively prevent the bearing section of the rocker arm from rising above the pivot of the lash adjuster.

According to the second aspect of the present invention, the axis of the osculating circle in a zero lift state is inclined toward the maximum force transmission point in relation to the direction of roller pressure force in a zero lift state. When the axis of the osculating circle is inclined toward the maximum force transmission point, the bearing section is not likely to rise above the pivot. Therefore, even when a sufficiently great maximum lift amount is to be generated, the present invention can effectively prevent the bearing section of the rocker arm from rising above the pivot of the lash adjuster.

According to the third aspect of the present invention, the axis of the osculating circle in a zero lift state is inclined toward the maximum force transmission point in relation to the axis of the valve disc. When the axis of the osculating circle is inclined toward the maximum force transmission point, the bearing section is not likely to rise above the pivot. Therefore, even when a sufficiently great maximum lift amount is to be generated, the present invention can effectively prevent the bearing section of the rocker arm from rising above the pivot of the lash adjuster.

According to the fourth aspect of the present invention, the axis of the lash adjuster is parallel to the direction of roller pressure force in a zero lift state. When the lash adjuster expands or contracts, it adjusts the clearance around the rocker arm. The configuration of the present invention causes the lash adjuster to expand and contract in the same direction as that of roller pressure force in a zero lift state. Therefore, the posture change of the rocker arm, which results from lash adjuster expansion/contraction, can be sufficiently reduced. Consequently, the present invention can exercise control to sufficiently reduce the changes in the valve opening characteristic, which result from temporal changes, and the difference in the valve opening characteristic between cylinders.

According to the fifth aspect of the present invention, the axis of the lash adjuster is parallel to the axis of the valve disc. It is necessary to provide a cylinder head with an opening for valve stem insertion and an opening for lash adjuster insertion. The configuration of the present invention makes it possible to prepare such openings from the same direction. Therefore, the present invention can simplify an internal combustion engine manufacturing process.

According to the sixth aspect of the present invention, a structure for supporting the rocker arm with the lash adjuster is implemented by the pivot having a spherically curved surface and the bearing section shaped like a shell. The shell-shaped space and the spherically curved surface inserted into the shell-shaped space come into contact with each other on a circle whose axis is the central axis of the shell-shaped space. Therefore, the present invention forms an osculating circle that is coaxial with the bearing section. In the present invention, the axis of the bearing section is given an inclination that should be satisfied by the axis of the osculating circle. Consequently, the present invention can inevitably form an osculating circle having a desired inclination.

According to the seventh aspect of the present invention, the transmission member presses the rocker roller from the side toward the lash adjuster in a great lift state. In the great lift state, therefore, a lateral force is applied to the bearing section of the rocker arm to press the pivot from the side toward the lash adjuster. In the present invention, the direction of the osculating circle's axis changes when the axis of the bearing section changes, that is, when the posture of the rocker arm changes. When the lift amount increases, the posture of the rocker arm changes to lower its end positioned toward the valve disc. Therefore, when the lift amount increases, the axis of the osculating circle changes in such a direction as to negate the direction of inclination in a zero lift state. Thus, the configuration of the present invention creates a situation in which the bearing section is most likely to rise above the pivot in a maximum lift state. In these premises, the present invention assures that the force transmitted to the pivot in a maximum lift state is directed toward the main body of the lash adjuster in relation to the center of the pivot's spherically curved surface. Consequently, the present invention can prevent the bearing section from rising above the pivot in all states ranging from zero lift to maximum lift.

According to the eighth aspect of the present invention, the transmission member presses the rocker roller from the side toward the valve disc in a great lift state. In the great lift state, therefore, a lateral force is applied to the bearing section of the rocker arm to press the pivot from the side toward the valve disc. Meanwhile, in the present invention, the axis of the osculating circle changes in such a direction as to increase the inclination in a zero lift state when the posture of the rocker arm changes in accordance with lift increase. Therefore, if the bearing section does not rise above the pivot in a zero lift state, the configuration of the present invention does not establish conditions for a bearing section rise in a subsequent lift amount increase process. In these premises, the present invention assures that the force transmitted to the pivot in a zero lift state is directed toward the main body of the lash adjuster in relation to the center of the pivot's spherically curved surface. Consequently, the present invention can prevent the bearing section from rising above the pivot in all states ranging from zero lift to maximum lift.

According to the ninth aspect of the present invention, a structure for supporting the rocker arm with the lash adjuster is implemented by the pivot having a spherically curved surface, which is partly a circular surface, and the bearing section having a spherically curved inner wall. This structure causes the pivot to come into contact with the bearing section at an outer circumference of the circular portion. The outer circumference forms an osculating circle. In this instance, the axis of the osculating circle remains fixed without regard to the posture of the rocker arm. In the present invention, the axis of the circular position of the pivot is given an inclination that should be satisfied by the axis of the osculating circle. Consequently, the present invention can inevitably form an osculating circle having a desired inclination.

According to the tenth aspect of the present invention, the outer circumference of the pivot's circular portion forms an osculating circle. Therefore, the axis of the osculating circle remains fixed without regard to the posture of the rocker arm. In this instance, no matter whether the transmission member presses the rocker roller from the side toward the lash adjuster or from the side toward the valve disc, the bearing section is most likely to rise above the pivot in a maximum lift state in which a great lateral force may be readily generated as the force of such rocker roller pressure. In these premises, the present invention assures that the force transmitted to the pivot in a maximum lift state is directed toward the main body of the lash adjuster in relation to the center of the pivot's spherically curved surface. Consequently, the present invention can prevent the bearing section from rising above the pivot in all states ranging from zero lift to maximum lift.

According to the eleventh aspect of the present invention, a variable valve mechanism for changing the lift amount in accordance with control shaft position can be combined with any one of the first to tenth aspects of the present invention. Further, according to the eleventh aspect of the present invention, the direction of force received by the rocker roller in a zero lift state can be adjusted to match the direction of lash adjuster expansion/contraction by making a line connecting the center of the control shaft to the center of the rocker roller parallel to the axis of the lash adjuster. Consequently, the present invention can implement the functions of the variable valve mechanism while sufficiently reducing the temporal changes in the valve opening characteristic and the difference in the valve opening characteristic between cylinders.

BEST MODE FOR CARRYING OUT THE INVENTION

First Embodiment

Configuration of First Embodiment

Figure 1:
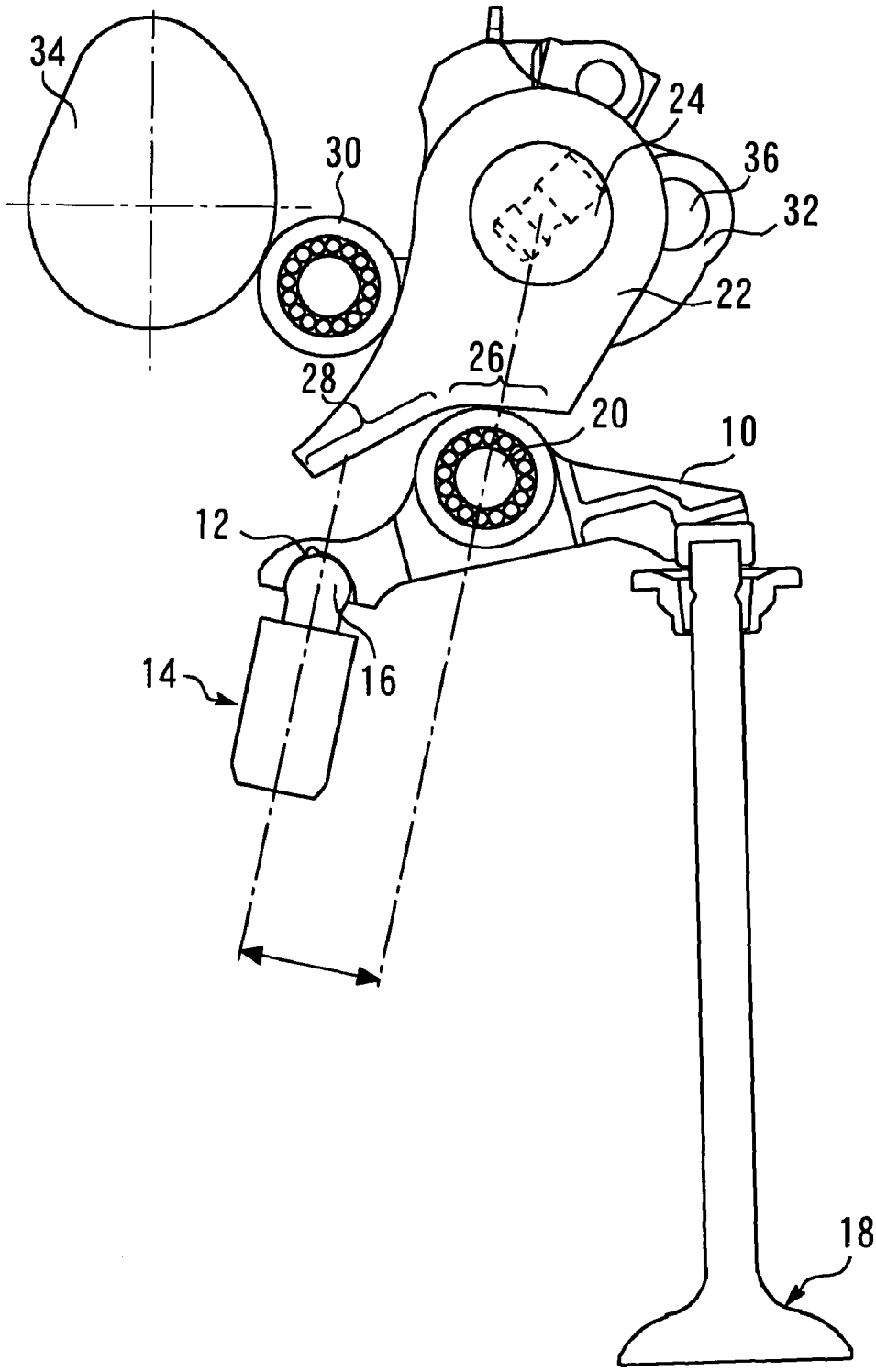
FIG. 1 illustrates a configuration of a valve mechanism according to a first embodiment of the present invention.

FIG. 1 illustrates the configuration of a valve mechanism according to a first embodiment of the present invention. The valve mechanism according to the first embodiment is built in an internal combustion engine's cylinder head and used as a mechanism for driving an internal combustion engine's intake valve or exhaust valve. As shown in FIG. 1, this mechanism includes a rocker arm 10.

The rocker arm 10 has a bearing section 12 at its one end. A pivot 16 for a hydraulic lash adjuster (HLA) 14 is inserted into the bearing section 12. The internal combustion engine's cylinder head has a hole for retaining the HLA 14. The HLA 14 is fastened to the cylinder head while it is inserted in the hole. The HLA 14 appropriately adjusts the clearance in the vicinity of the rocker arm 10 by hydraulically adjusting the position of the pivot 16 in an axis direction.

The other end of the rocker arm 10 is in contact with the upper end of a valve disc 18. The cylinder head has a hole for retaining the valve disc 18. The valve disc 18 is slidably retained in the hole and pressed toward the rocker arm 10 by a valve spring (not shown). FIG. 1 shows that the rocker arm 10 is in a zero lift state and that the valve disc 18 is retained in a fully closed position accordingly.

A rocker roller 20 is positioned at the center of the rocker arm 10. The rocker roller 20 can freely rotate around a central shaft that is fastened to the rocker arm. A swing arm 22 is positioned over the rocker roller 20 to transmit the pressure force of a cam to the rocker roller 20.

A control shaft 24 is inserted into the swing arm 22. The swing arm 22 can swing by using the control shaft 24 as a rotation axis. The swing arm 22 has an arc area 26 and a pressure area 28, which are positioned in a section that is in contact with the rocker roller 20. The arc area 26 is formed to draw an arc that is uniformly distant from the center of the control shaft 24. The pressure area 28 is formed so that the distance from the center of the control shaft 24 increases with a decrease in the distance to a leading end (a lower left part in FIG. 1).

A slide roller 30 is positioned opposite the rocker arm 20 so that the swing arm 22 is sandwiched between the rocker arm 20 and slide roller 30. Referring to FIG. 1, a center arm 32 is positioned behind the swing arm 22. The slide roller 30 is rotatably retained by the leading end of the center arm 32 and positioned between the swing arm 22 and a cam 34.

The center arm 32 is coupled to the control shaft 24 via a link mechanism 36. The link mechanism 36 functions so that the pivoting motion of the control shaft 24 is reflected in the position of the slide roller 30. In the configuration shown in FIG. 1, the position of the slide roller 30 is regulated by the cam 34, swing arm 22, and link mechanism 32. When the control shaft 24 rotates to change the status of the link mechanism 36, the slide roller 30 moves upward or downward, as viewed in FIG. 1, while it is sandwiched between the cam 34 and swing arm 22.

Operation of Valve Mechanism

FIG. 1 shows that a base surface of the cam 34 is in contact with the slide roller 30. In this instance, the swing arm 22 is in contact with the rocker roller 20 within the arc area 26. Consequently, a zero lift state prevails. When the cam 34 rotates, the slide roller 30 is pressed by a cam nose. When the slide roller 30 is pressed, the swing arm 22 rotates around the control shaft 24 and toward the rocker roller 20.

While the swing arm 22 is in contact with the rocker roller 20 within the arc area 26 after the aforementioned rotation, the posture of the rocker arm 10 remains unchanged so that the zero lift state persists. This position is hereinafter referred to as the "base position" of the swing arm 22. While the swing arm 22 is at the base position, the contact point between the rocker roller 20 and swing arm 22 is positioned on a line that connects the center of the rocker roller 20 to the center of the control shaft 24. This contact point is hereinafter referred to as the "base contact point."

Figure 2:
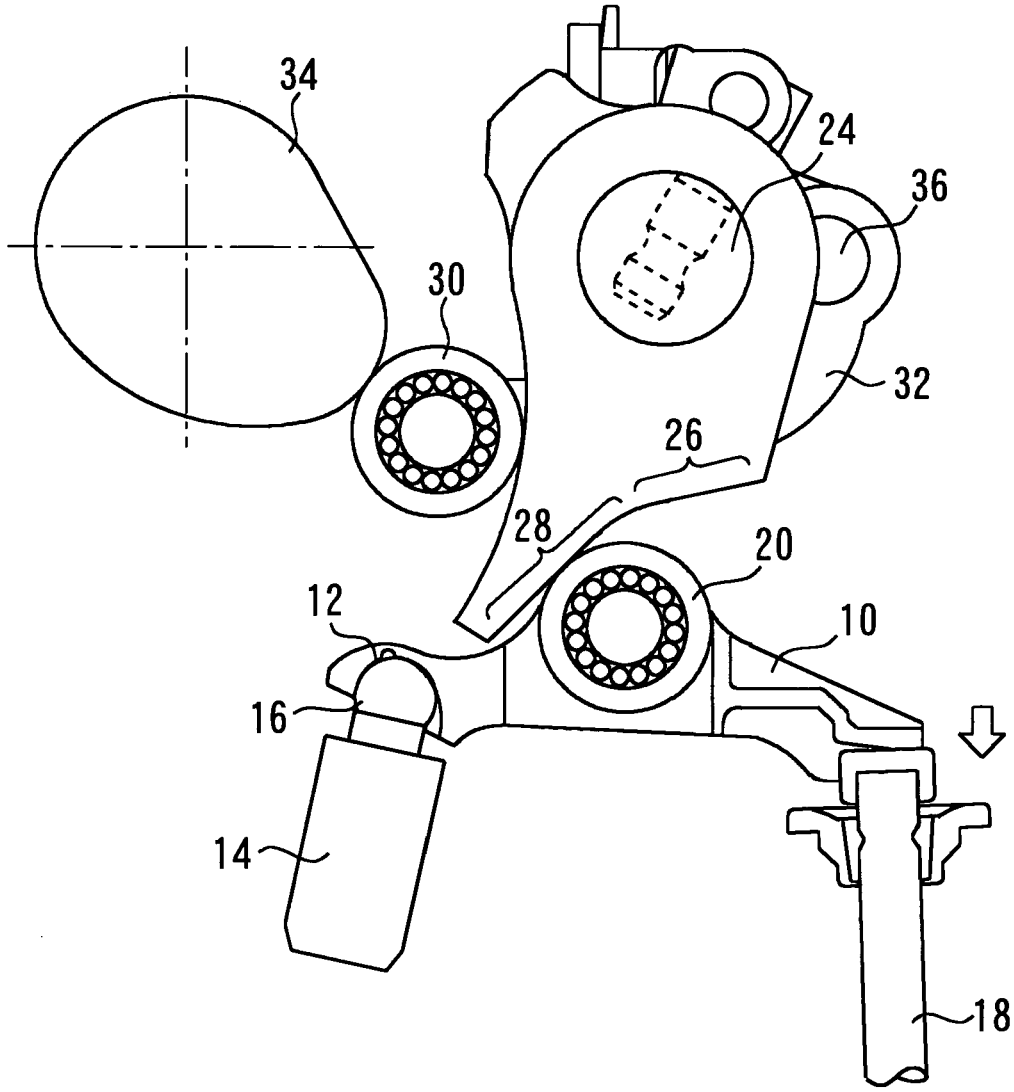
FIG. 2 shows the valve mechanism shown in FIG. 1 in which a swing arm is rotated by being pressed by a cam nose.

FIG. 2 shows that the swing arm 22 is further rotated when pressed by the cam nose. When the rotation angle of the swing arm 22 increases, the pressure area 28 begins to press the rocker roller 20. Consequently, the rocker arm 10 rotates on the pivot 12 of the HLA 14 to lift the valve disc 18 in a valve opening direction. In a situation where the swing arm 22 is in contact with the rocker roller 20 within the pressure area 28, an increase in the rotation angle of the swing arm 22, that is, an increase in the lift amount of the valve disc 18, causes a point at which the rocker roller 20 contacts the swing arm 22 to move from the aforementioned base contact point (see FIG. 1) toward the HLA 14.

In the valve mechanism shown in FIG. 1, the position of the slide roller 30 can be changed by rotating the control shaft 24. When the slide roller 30 moves upward or downward from its position shown in FIG. 1, the base position of the swing arm 22 changes. When the base position of the swing arm 22 changes from the position shown in FIG. 1 to a position that is reached upon clockwise rotation, the swing arm 22 begins to rotate as it is pressed by the cam 34. Then, the period during which the arc area 26 is in contact with the rocker roller 20 extends. As a result, the amount by which the rocker roller 20 is pressed by the pressure area 28 decreases to decrease the maximum lift amount of the valve disc 18. When, on the contrary, the base position of the swing arm 22 changes to a position that is reached upon counterclockwise rotation from the position shown in FIG. 1, the maximum lift amount of the valve disc 18 increases. In the valve mechanism shown in FIG. 1, the maximum lift amount provided by the valve disc 18 can be changed by rotating the control shaft 24, as described above.

As the lift amount of the valve disc 18 increases, the contact point at which the rocker roller 20 contacts the swing arm 22 moves from the base contact point toward the HLA 14, as described above. As the contact point moves closer toward the HLA 14, a greater force is laterally applied to the rocker roller 20 as viewed in FIG. 1. In the valve mechanism shown in FIG. 1, therefore, a great lateral force is applied to the rocker roller 20 in a situation where the maximum lift amount is generated particularly when a great lift operation is selected.

Features of First Embodiment

The lateral force applied to the rocker roller 20 is exerted between the bearing section 12 of the rocker arm 10 and the pivot 16 of the HLA 14. The lateral force may cause the bearing section 12 to rise above the pivot 16 depending on the magnitude of the lateral force or the posture of the rocker arm 10. The valve mechanism according to the present embodiment can properly avoid such a rise.

Figure 3A:
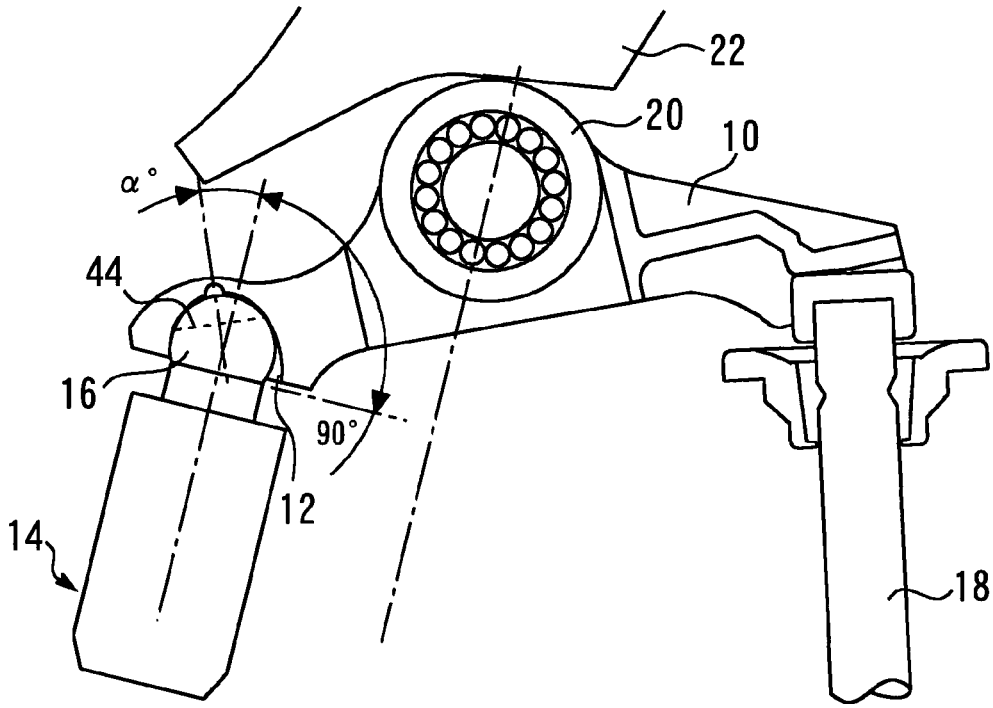
FIGS. 3A and 3B illustrate a characteristic configuration of valve mechanism according to the first embodiment of the present invention.

FIG. 3A illustrates a configuration that the present embodiment uses to implement the above characteristic function. As shown in FIG. 3A, a portion of the pivot 16 of the HLA 14 that is to be inserted into the bearing section 12 has a spherically curved surface. Meanwhile, the bearing section 12 is a shell-like dent, or more specifically, a rotator-shaped dent having an apex at its leading end and a lateral surface that is a curved surface having a larger curvature radius than the spherically curved surface of the pivot 16. Further, the axis of the shell-shaped bearing section 12 is inclined toward a side opposite the rocker roller 20 in relation to the axis of the HLA 14.

Figure 3B:
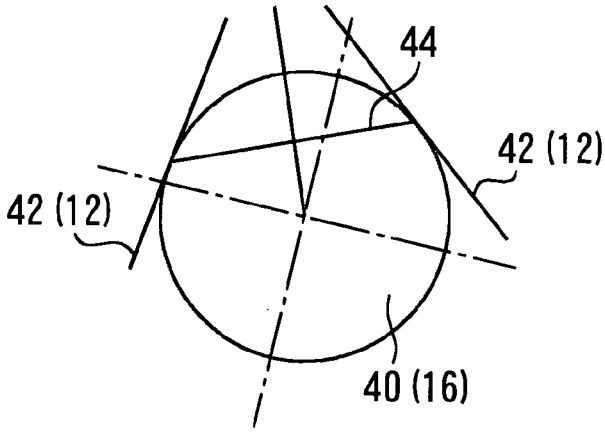

FIG. 3B is a conceptual diagram illustrating the contact between the pivot 16 and bearing section 12. In FIG. 3B, a sphere 40 represents the spherically curved surface of the pivot 16. Two tangent lines 42 represent an inner wall of the bearing section 12. Since the inner wall of the bearing section 12 has a larger curvature radius than the spherically curved surface of the pivot 16, the contact between the pivot 16 and bearing section 12 can be depicted as shown in FIG. 3B. As the pivot 16 and bearing section 42 are both rotators, they come into contact with each other on a circle 44. This circle is hereinafter referred to as the "osculating circle 44."

Configuration and Operation of Comparative Example

Figure 4A:
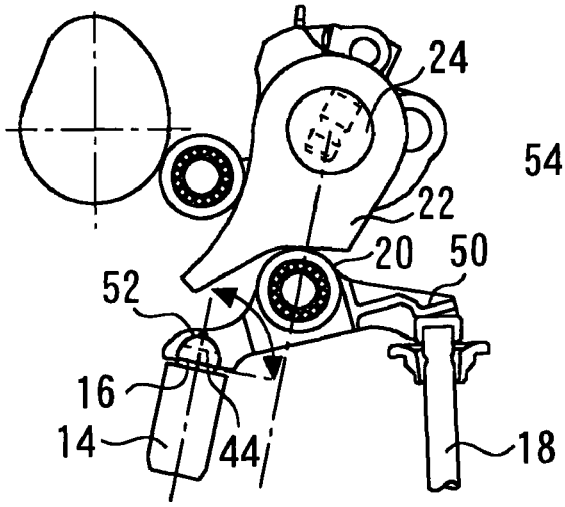
FIGS. 4A and 4B illustrate a configuration in a zero lift state of a comparative example that is to be compared against the valve mechanism according to the first embodiment of the present invention.

FIG. 4A shows the configuration of a comparative example that is to be compared against the valve mechanism according to the present embodiment. The comparative example shown in FIG. 4A is configured the same as the valve mechanism according to the present embodiment except that the bearing section 52 of the rocker arm 50 is coaxial with the HLA 16.

FIG. 4A shows a zero lift state. In this state, the rocker roller 20 comes into contact with the swing arm 22 at the base contact point. In this instance, a roller pressure force having the same direction as a line segment connecting the center of the control shaft 24 to the center of the rocker roller 20 is exerted on the rocker roller 20. The rocker arm 50 transmits the roller pressure force to the bearing section 52. As a result, a force parallel to the roller pressure force is exerted between the bearing section 52 and pivot 16.

Figure 4B:
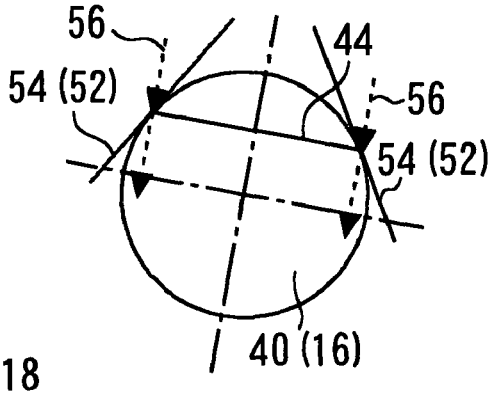

FIG. 4B shows the comparative example to illustrate the contact between the pivot 16 and bearing section 52 and the direction of force exerted in a zero lift state. In FIG. 4B, the sphere 40 and tangent line 54 represent the spherically curved surface of the pivot 16 and the wall surface of the bearing section 52, respectively. In the comparative example, the axis of the bearing section 52 is equal to the axis of the HLA 14 as described earlier.

The axis of the HLA 14 is parallel to the direction of a straight line connecting the center of the control shaft 24 to the center of the rocker roller 20, that is, the direction of roller pressure force in a zero lift state. In the zero lift state, therefore, a force 56 parallel to the axis of the HLA 14 is exerted between the bearing section 52 and pivot 16 (exerted on the osculating circle 44) as shown in FIG. 4B. This force 56 presses the bearing section 52 against the pivot 16. In this instance, the bearing section 52 does not rise above the pivot 16.

Figure 5A:
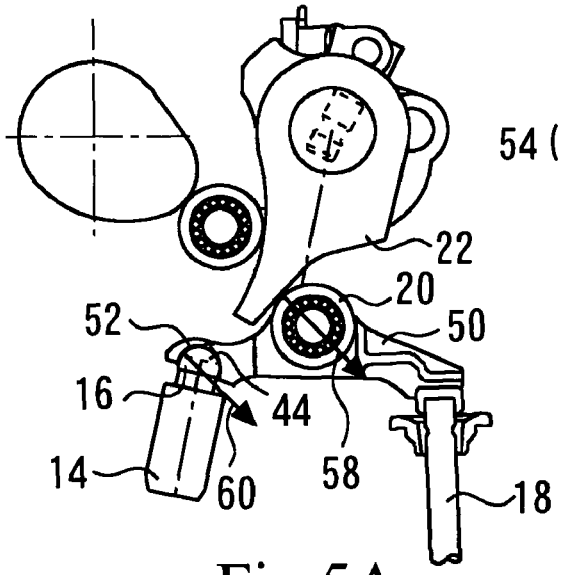
FIGS. 5A and 5B illustrate a configuration in a maximum lift state of the comparative example.

FIG. 5A shows a state in which a maximum lift is given to the valve disc 18 in the valve mechanism according to the comparative example. When the lift amount of the valve disc 18 increases, the posture of the rocker arm 50 changes to lower its end that is positioned toward the valve disc 50. The inclination of the osculating circle 44 between the bearing section 52 and pivot 16 varies with the posture of the rocker arm 50. In a maximum lift state, therefore, the configuration of the comparative example inclines the osculating circle 44 in such a manner as to lower the side toward the valve disc 18 and raise the side toward the HLA.

In a state where the maximum lift is generated, the contact point at which the rocker roller 20 contacts the swing arm 22 is considerably shifted from the base contact point toward the HLA 14. Thus, a roller pressure force 58 containing a lateral component is exerted on the rocker roller 20. Further, a pressure force 60 containing a lateral component is exerted between the bearing section 52 and pivot 16.

Figure 5B:
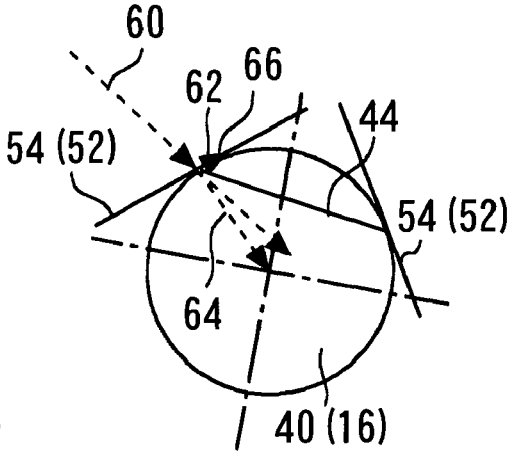

FIG. 5B illustrates the direction of force that is exerted on the pivot section according to the comparative example in a maximum lift state. The force 60 transmitted to the bearing section 52 is transmitted to the pivot 16 via all points on the osculating circle 44. The force transmitted via the osculating circle 44 is maximized at a point 62 that is closer to the HLA 14 than any other point on the osculating circle 44 (this point 62 is hereinafter referred to as the "maximum force transmission point 62").

The force 60 applied to the maximum force transmission point 62 can be regarded as separable into a radial component 64, which is directed toward the center of the pivot 16, and a tangential component 66, which is perpendicular to the radial component 64. The radial component 64 presses the bearing section 52 against the pivot 16, and does not relatively reposition the bearing section 52 and pivot 16 without regard to its magnitude. Therefore, when the rise of the bearing section 52 is to be considered, the radial component 64 can be ignored.

On the other hand, the tangential component 66 slides the bearing section 52 in relation to the pivot 16. The bearing section 52 cannot move in the direction of further inserting the pivot 16. Therefore, as far as the tangential component 66 is directed in the direction of further inserting the pivot 16, that is, in a lower left direction as viewed in FIG. 5B, the bearing section 52 does not rise. If, on the other hand, the tangential component 66 is directed in the direction of retracting the pivot as shown in FIG. 5B, the bearing section 52 rises above the pivot 16. Consequently, if the valve disc 18 is given a great lift, the valve mechanism according to the comparative example may cause the bearing section 52 to rise.

Operation of First Embodiment

Figure 6A:
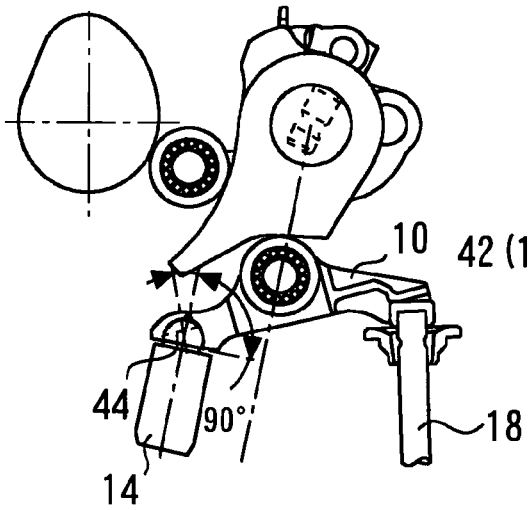
FIGS. 6A and 6B illustrate a configuration in a zero lift state of the valve mechanism according to the first embodiment of the present invention.
Figure 6B:
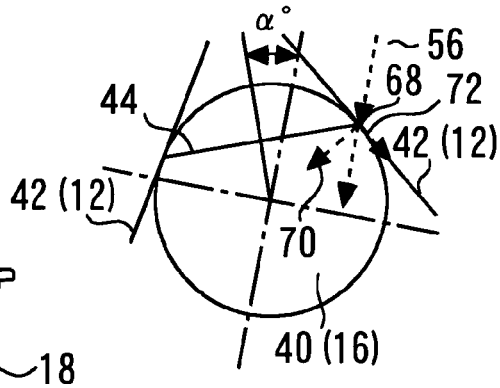
Figure 7A:
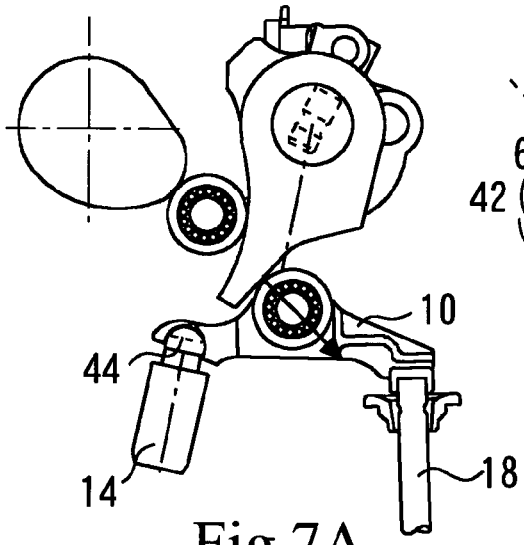
FIGS. 7A and 7B illustrate a configuration in a maximum lift state of the valve mechanism according to the first embodiment of the present invention.
Figure 7B:
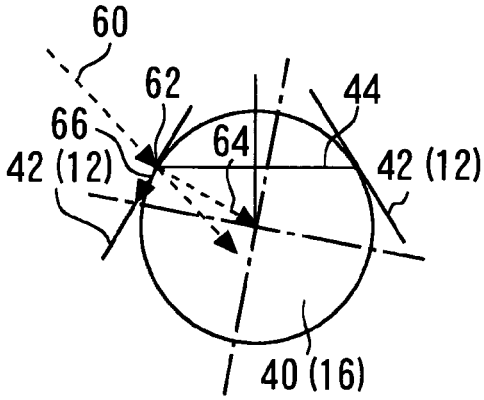

FIGS. 6A, 6B, 7A, and 7B illustrate the operation of the valve mechanism according to the first embodiment of the present invention. More specifically, FIGS. 6A and 6B show a zero lift state, whereas FIGS. 7A and 7B show a maximum lift state.

In the valve mechanism according to the present embodiment, the axis of the osculating circle 44 in the zero lift state is inclined at an angle of $\alpha°$ relative to the axis of the HLA 14 as shown in FIG. 6B. In other words, the axis of the osculating circle 44 in the zero lift state is inclined at an angle of $\alpha°$ relative to the direction of force 56 that is exerted on the bearing section 12. In this instance, the force transmitted from the bearing section 12 to the pivot 16 is maximized at a point 68 that is closer to the valve disc 18 than any other point on the osculating circle 44. Further, the force 56 exerted on this point 68 can be regarded as separable into a radial component 70, which is directed toward the center of the pivot 16, and a tangential component 72, which is perpendicular to the radial component 70. In this instance, the tangential component 72 is directed in the direction of further inserting the pivot 16. Consequently, the valve mechanism according to the present embodiment does not permit the bearing section 12 to rise in the zero lift state.

In a maximum lift state, the axis of the osculating circle 44 is still inclined toward the maximum force transmission point 62 in relation to the axis of the HLA 14, as shown in FIG. 7B. In other words, when the posture of the rocker arm 18 changes to lift the valve disc 18, the valve mechanism according to the present embodiment reduces the inclination of the axis of the osculating circle 44 from the axis of the HLA 14. If this inclination is excessively small, the tangential component 66, which causes the bearing section 12 to rise, is generated as described with reference to the comparative example.

Under such circumstances, the present embodiment allows the inclination shown in FIG. 7B to prevail in the maximum lift state by inclining the axis of the osculating circle in a zero lift state at an angle of $\alpha°$ toward the maximum force transmission point 62. In other words, the present embodiment sets the above inclination angle $\alpha°$ so that the force exerted on the maximum force transmission point 62 in the maximum lift state is directed below the center of the pivot 16, that is, directed toward the main body of the HLA 14.

Under the conditions described above, the force exerted on the maximum force transmission point 62 in the maximum lift state includes the tangential component 66, which is directed to further insert the pivot 16, as shown in FIG. 7B. Consequently, the valve mechanism according to the present embodiment can properly prevent the bearing section 12 from rising even in the maximum lift state.

When the lift amount of the valve disc 18 increases, the valve mechanism according to the present embodiment negates the inclination of the osculating circle 44, which is provided in a zero lift state, and increase the lateral component included in the force 60 exerted on the bearing section 12. In other words, when the lift of the valve disc 18 increases, the valve mechanism according to the present embodiment switches to a state in which an upward tangential component 66 is readily generated. Therefore, if such a tangential component 66 is not generated in the maximum lift state, it is possible to avoid the rise of the bearing section 12 in all lift regions. For the reason described above, the valve mechanism according to the present embodiment can properly prevent the bearing section 12 from rising above the pivot 16 even when a sufficiently great maximum lift amount is to be generated.

As described above, the valve mechanism according to the first embodiment is configured so that the axis of the HLA 14 is parallel to the direction of a straight line connecting the center of the control shaft 24 to the center of the rocker roller 20, that is, the direction of roller pressure force in the zero lift state (therefore, the inclination angle $\alpha°$ of the osculating circle 44 is not only an inclination angle relative to the axis of the HLA 14 but also an inclination angle relative to the direction of roller pressure force in the zero lift state). The HLA 14 functions to maintain a state in which the swing arm 22 properly contacts with the rocker roller 20. Adjustments for maintaining such a state are made by changing the vertical position of the pivot 16.

If the axis of the HLA 14 is parallel to the roller pressure force in the zero lift state, the posture changes of the rocker arm 10, which are caused by the vertical motion of the pivot 16, can be minimized. The posture of the rocker arm 10 in the zero lift state is a factor that affects the valve opening characteristic of the valve disc 18. Therefore, if the posture changes can be minimized, it is possible to sufficiently reduce the changes in the valve opening characteristic, which result from temporal changes, and the difference in the valve opening characteristic between cylinders. In this respect, the valve mechanism according to the present embodiment can steadily maintain the operating state of an internal combustion engine over a long period of time.

To avoid the rise of the bearing section 18, however, it is not always necessary to make the axis of the HLA 14 parallel to the roller pressure force in the zero lift state. Therefore, if the posture changes of the rocker arm 10, which result from adjustments made by the HLA 14, are ignorable, the HLA 14 may be positioned so that its axis is inclined relative to the direction of roller pressure force in the zero lift state.

The first embodiment, which has been described above, assumes that the valve mechanism uses the control shaft 24 and swing arm 22 to change the lift amount of the valve disc 18. However, the present invention is not limited to the use of such a configuration. More specifically, the valve mechanism may be without the control shaft 24 and swing arm 22 as far as a roller pressure force input point for the rocker roller 20 varies with the lift amount. The same also holds true for the other embodiments that will be described later.

In the first embodiment, which has been described above, the swing arm 22 corresponds to the "transmission member" according to the first or second aspect of the present invention. Further, in the first embodiment, which has been described above, the center arm 32 and link mechanism 36 correspond to the "base rotation position change mechanism" according to the eleventh aspect of the present invention; and the slide roller 30 corresponds to the "cam operation conversion mechanism" according to the eleventh aspect of the present invention.

Second Embodiment

Configuration of Second Embodiment

Figure 8:
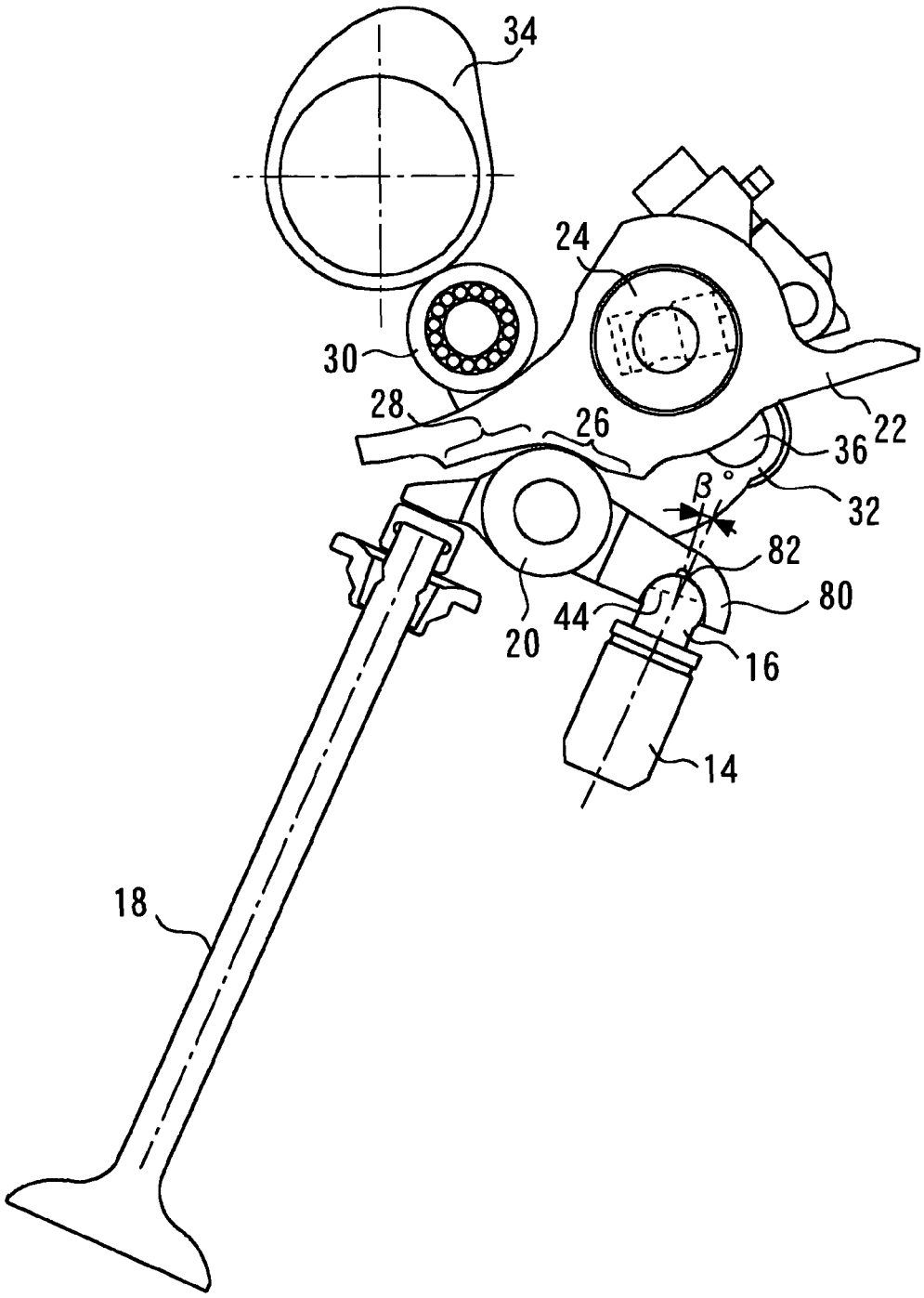
FIG. 8 illustrates a configuration of a valve mechanism according to a second embodiment of the present invention.

A second embodiment of the present invention will now be described with reference to FIGS. 8 to 11. FIG. 8 illustrates the configuration of the valve mechanism according to the second embodiment. The valve mechanism according to the first embodiment, which was described earlier, is constructed so that the pressure area 28 of the swing arm 22 presses the rocker roller 20 from the side toward the HLA 14. On the other hand, the valve mechanism according to the second embodiment is configured so that the pressure area 28 of the swing arm 22 presses the rocker roller 20 from the side toward the valve disc 18.

The valve mechanism according to the present embodiment is substantially equal to the valve mechanism according to the first embodiment except that the inclination direction of the bearing section 82 provided for the rocker arm 80 is different in addition to the aforementioned structural difference. Like members used in the first and second embodiments are identified by like reference numerals and will not be repeatedly described or will be briefly described.

FIG. 8 shows a zero lift state. While the valve mechanism according to the present embodiment is in this state, the rocker roller 20 also comes into contact with the swing arm 22 at the base contact point on a line segment connecting the center of the control shaft 24 to the center of the rocker roller 20. Further, in the present embodiment, the axis of the bearing section 82 for the rocker arm 80 is inclined toward the rocker roller 20 at an angle of β° relative to the axis of the HLA 14.

Figure 9:
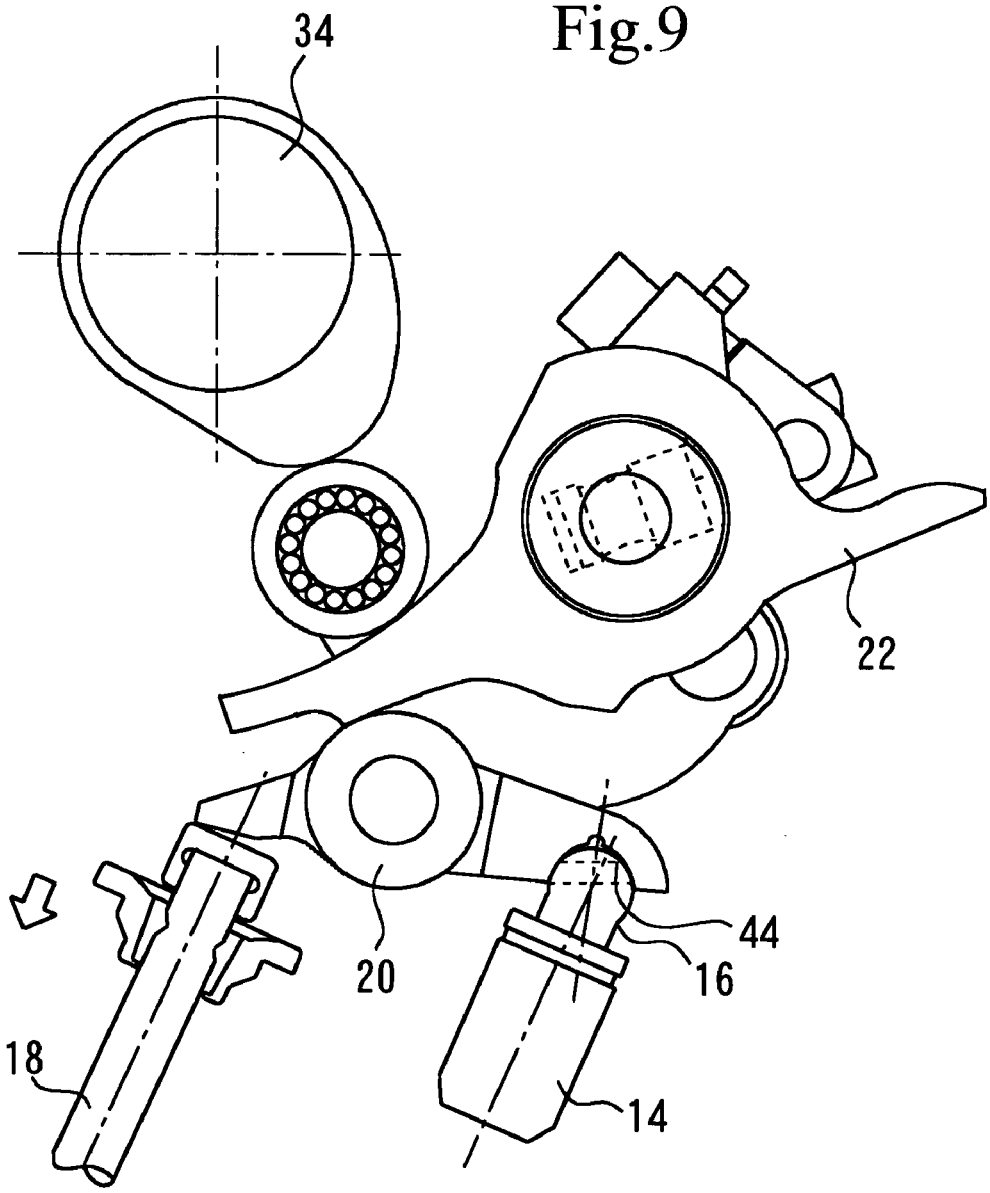
FIG. 9 shows the valve mechanism shown in FIG. 8 in which a swing arm is rotated by being pressed by a cam nose.

FIG. 9 shows a maximum lift state. As shown in FIG. 9, the contact point at which the rocker roller 20 contacts the swing arm 22 is shifted from the base contact point toward the valve disc 18 in the maximum lift state. As a result, the lateral component included in the roller pressure force applied to the rocker roller 20 increases with an increase in the lift amount. Meanwhile, in the configuration of the present embodiment, the inclination angle of the osculating circle 44 relative to the axis of the HLA 14 increases with an increase in the lift amount.

Operation of Second Embodiment

Figure 10A:
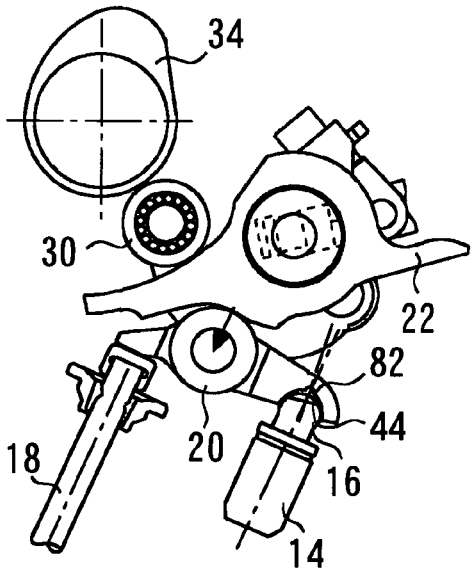
FIGS. 10A and 10B illustrate a configuration in a zero lift state of the valve mechanism according to the second embodiment of the present invention.
Figure 10B:
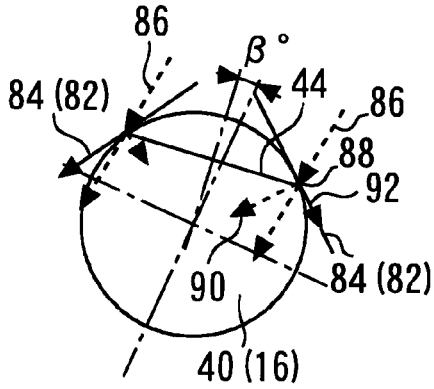
Figure 11A:
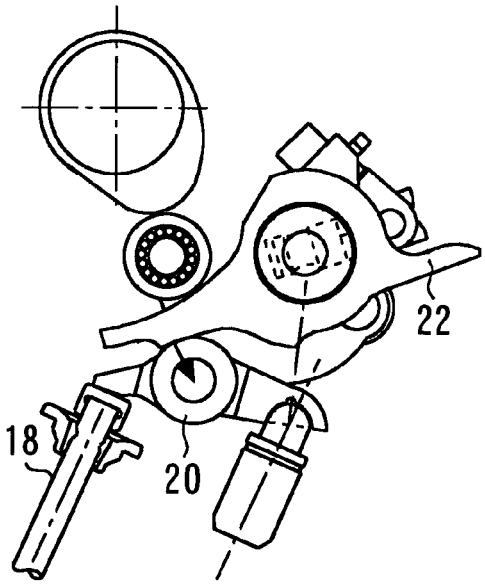
FIGS. 11A and 11B illustrate a configuration in a maximum lift state of the valve mechanism according to the second embodiment of the present invention.
Figure 11B:
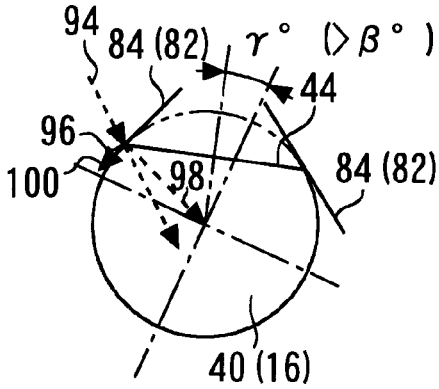

FIGS. 10A, 10B, 11A, and 11B illustrate the operation of the valve mechanism according to the second embodiment of the present invention. More specifically, FIGS. 10A and 10B show a zero lift state, whereas FIGS. 11A and 11B show a maximum lift state.

In FIG. 10B, a sphere 40 and a tangent line 84 represent the spherically curved surface of the pivot 16 and the wall surface of the bearing section 82, respectively. In the valve mechanism according to the present embodiment, the axis of the osculating circle 44 in the zero lift state is inclined toward the valve disc 18 at an angle of β° relative to the axis of the HLA 14, that is, inclined toward a direction in which the posture of the rocker arm 80 changes in accordance with a lift increase. In this instance, the force 86 transmitted from the bearing section 82 to the pivot 16 is maximized at a point 88 that is closer to the HLA 14 than any other point on the osculating circle 44. The force 86 exerted on this point 88 can be regarded as separable into a radial component 90, which is directed toward the center of the pivot 16, and a tangential component 92, which is perpendicular to the radial component 90. In this instance, the tangential component 92 is directed in the direction of further inserting the pivot 16. Consequently, the valve mechanism according to the present embodiment does not permit the bearing section 12 to rise in the zero lift state.

In the maximum lift state, the axis of the osculating circle 44 is inclined toward the valve disc 18 in relation to the axis of the HLA 14, as shown in FIG. 11B. In the present embodiment, the posture of the rocker arm 80 changes to lower the end of the valve disc 18 when the lift amount increases. Therefore, the inclination angle γ° formed on the osculating circle 44 in the maximum lift state is larger than the inclination angle β° formed in the zero lift state.

When the swing arm 22 applies roller pressure force to the rocker roller 20 from the side toward the valve 18, the more inclined toward the valve disc 18 is the axis of the osculating circle 44, the less likely the bearing section 82 will rise. In the valve mechanism according to the present embodiment, therefore, an increase in the lift amount increases the inclination angle of the osculating circle 44 in a direction favorable for preventing the rise of the bearing section 82. Consequently, as far as the force for raising the bearing section 82 in the zero lift state is not generated, it is difficult for the valve mechanism according to the present embodiment to generate the force for raising the bearing section 82 in all lift regions.

As shown in FIG. 11B, the force 94 transmitted from the bearing section 82 to the pivot 16 in the maximum lift state is maximized at a point (maximum force transmission point) 96 that is closer to the valve disc 18 than any other point on the osculating circle 44. The force 94 exerted on the maximum force transmission point 96 can be regarded as separable into a radial component 98, which is directed toward the center of the pivot 16, and a tangential component 100, which is perpendicular to the radial component 98. Referring to FIG. 11B, the tangential component 100 is directed in the direction of further inserting the pivot 16. Consequently, the valve mechanism according to the present embodiment does not permit the bearing section 12 to rise in the maximum lift state.

As described above, the valve mechanism according to the present embodiment prevents the rise of the bearing section 12 in all lift regions by inclining the axis of the osculating circle 44 in the zero lift state at an angle of β° toward the valve disc 18 (toward the maximum force transmission point 96). In other words, the inclination angle β° according to the present embodiment is set so that the force exerted on the point 88 for transmitting the maximum force in the zero lift state is directed below the center of the pivot 16 (directed toward the main body of the HLA 14), and that the force exerted on the maximum force transmission point 96 in the maximum lift state is directed below the center of the pivot 16 (directed toward the main body of the HLA 14). Consequently, the valve mechanism according to the present embodiment can properly prevent the rise of the bearing section 12 while maintaining a sufficiently great maximum lift amount, as is the case with the valve mechanism according to the first embodiment.

Meanwhile, the valve mechanism according to the present embodiment assumes that the axis of the valve disc 18 is parallel to the axis of the HLA 14 (therefore, the inclination angle γ° of the osculating circle 44 is not only an inclination angle relative to the axis of the HLA 14 but also an inclination angle relative to the axis of the valve disc 18). As described earlier, it is necessary to provide the cylinder head with an opening for retaining the valve disc 18 and an opening for retaining the HLA 14. If their axes are parallel to each other, it is possible to prepare such openings from the same direction and at the same angle. In this respect, the valve mechanism according to the present embodiment can make a cylinder head machining process easy.

To avoid the rise of the bearing section 18, however, it is not always necessary to make the axis of the valve disc 18 parallel to the axis of the HLA 14. Therefore, if machining process facilitation is not absolutely demanded, the HLA 14 may be positioned so that its axis is inclined relative to the axis of the valve disc 18.

In the second embodiment, which has been described above, the swing arm 22 corresponds to the "transmission member" according to the third aspect of the present invention. Further, in the second embodiment, which has been described above, the center arm 32 and link mechanism correspond to the "base rotation position change mechanism" according to the eleventh aspect of the present invention; and the slide roller 30 corresponds to the "cam operation conversion mechanism" according to the eleventh aspect of the present invention.

Third Embodiment

Configuration of Third Embodiment

Figure 12:
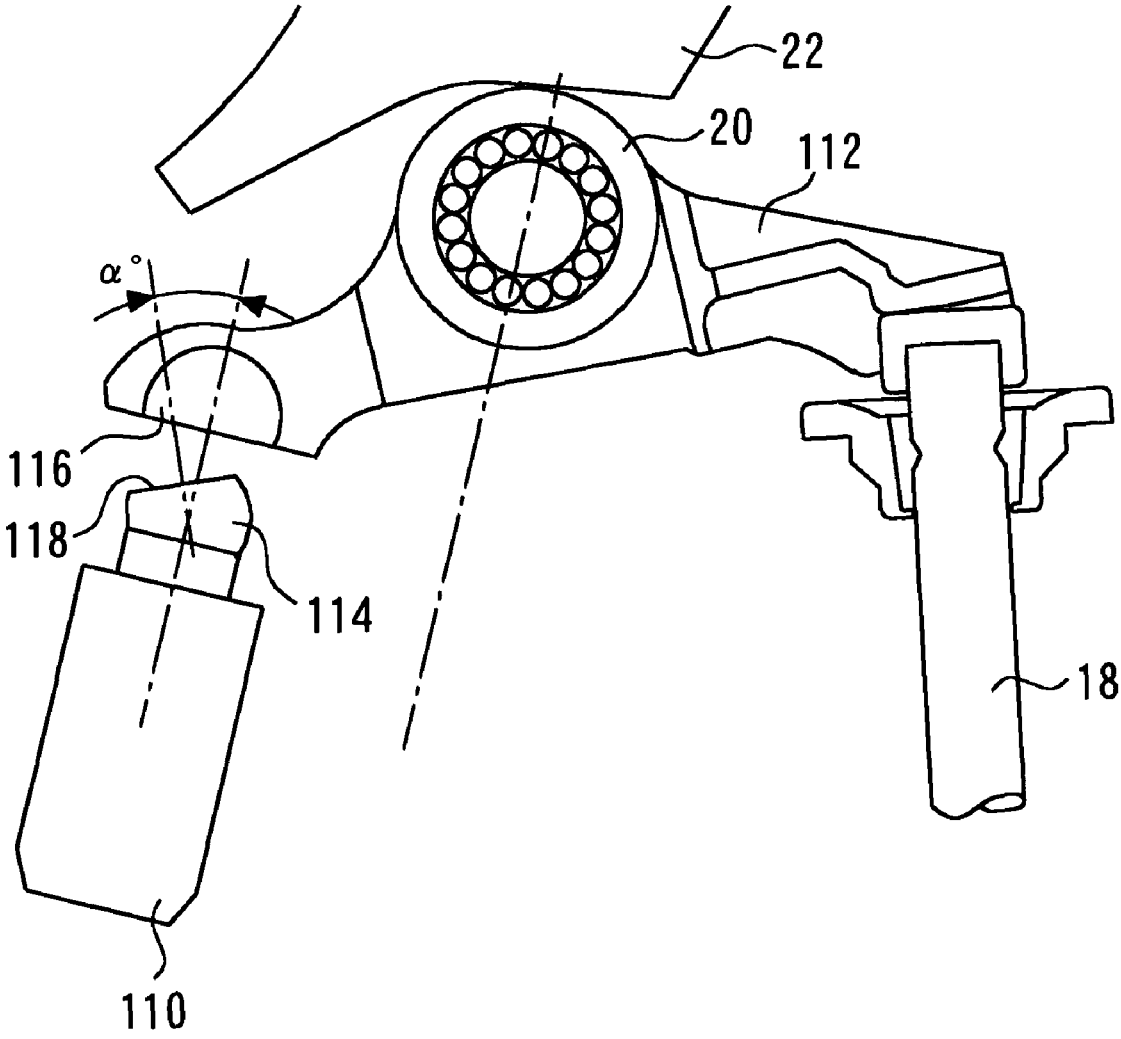
FIG. 12 illustrates a characteristic configuration of valve mechanism according to a third embodiment of the present invention.

A third embodiment of the present invention will now be described with reference to FIGS. 12 to 14. FIG. 12 is an enlarged view illustrating the HLA 110 and rocker arm 112 that are used in the third embodiment of the present invention. The valve mechanism according to the present embodiment is the same as the valve mechanism according to the first embodiment, which has been described earlier, except that the pivot 114 of the HLA 110 and the bearing section 116 of the rocker arm 112 differ in shape from the counterparts used in the first embodiment.

As shown in FIG. 12, the pivot 114 for use in the present embodiment has a spherically curved surface a part of which is circularly cut. This spherically curved surface is positioned for insertion into the bearing section 116. The bearing section 116 is a spherical dent having a larger curvature radius than the spherically curved surface of the pivot 114. Since the employed configuration is as described above, the pivot 114 comes into contact with the inner wall of the bearing section 116 at an outer circumference of the circularly cut surface 118. As a result, the present embodiment also forms an osculating circle between the pivot 114 and bearing section 116.

The cut surface 118 is formed so that its axis is inclined at an angle of a° relative to the axis of the HLA 114. The HLA 110 is positioned so that an inclination of α° arises opposite the rocker roller 20 in relation to the axis of the HLA 110. Consequently, the osculating circle according to the present embodiment has the same inclination as the osculating circle 44 according to the first embodiment that is formed in the zero lift state.

Operation of Third Embodiment

Figure 13A:
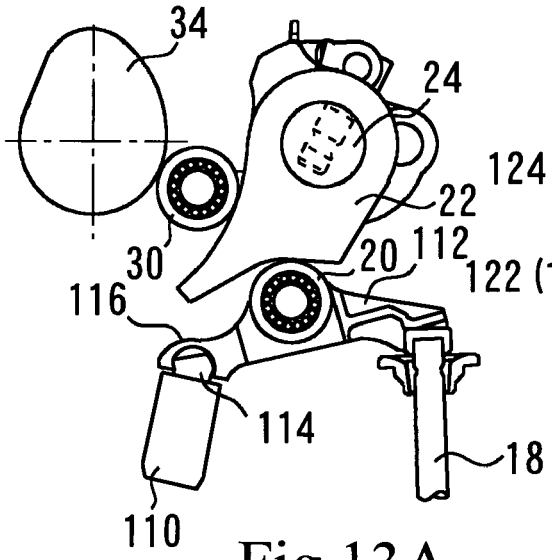
FIGS. 13A and 13B illustrate a configuration in a zero lift state of the valve mechanism according to the third embodiment of the present invention.
Figure 13B:
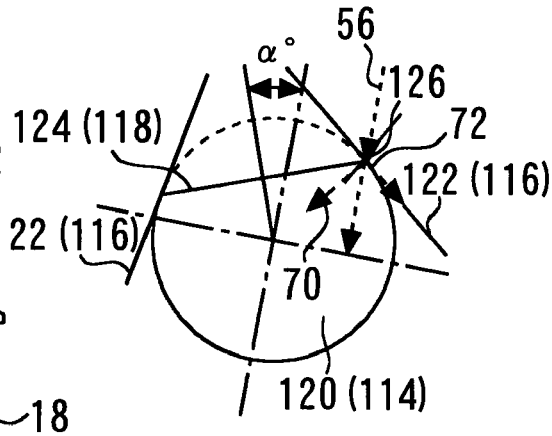
Figure 14A:
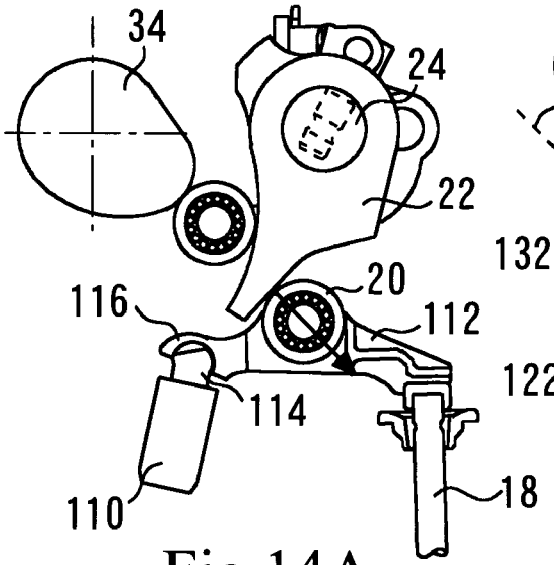
FIGS. 14A and 14B illustrate a configuration in a maximum lift state of the valve mechanism according to the third embodiment of the present invention.
Figure 14B:
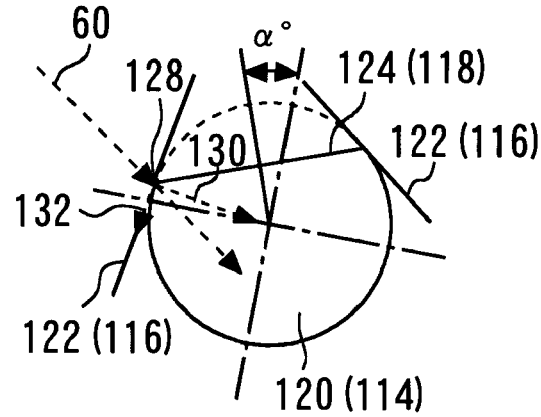

FIGS. 13A, 13B, 14A, and 14B illustrate the operation of the valve mechanism according to the third embodiment of the present invention. More specifically, FIGS. 13A and 13B show a zero lift state, whereas FIGS. 14A and 14B show a maximum lift state.

In FIG. 13B, a sphere 120 and a tangent line 122 represent the spherically curved surface of the pivot 114 and the wall surface of the bearing section 116, respectively. An osculating circle 124 represents the outer circumference of the circular cut surface 118. In the valve mechanism according to the present embodiment, the axis of the osculating circle 124 in the zero lift state is inclined toward the HLA 110 at an angle of α° relative to the axis of the HLA 14. In this instance, the force 56 transmitted from the bearing section 116 to the pivot 114 is maximized at a point 126 that is closer to the valve disc 18 than any other point on the osculating circle 124. As is the case with the first embodiment, the force 56 exerted on this point 126 has a tangential component 72, which is directed in the direction of further inserting the pivot 114. Consequently, the valve mechanism according to the present embodiment does not permit the bearing section 116 to rise in the zero lift state.

In the valve mechanism according to the present embodiment, the osculating circle 124 is formed by the outer circumference of the cut surface 118 of the pivot 110. The inclination angle of the cut surface 118 remains unchanged without regard to the posture of the rocker arm 112. In the present embodiment, therefore, the inclination angle of the osculating circle 124 relative to the axis of the HLA 110 is maintained at □□ even in the maximum lift state, as shown in FIG. 14B.

In the maximum lift state, a point 128 closer to the HLA 110 than any other point on the osculating circle 124 is the maximum force transmission point 128, which transmits the greatest force. To prevent the generation of the force directed to raise the bearing section 116 in the maximum lift state, the inclination of the osculating circle 124 toward the maximum force transmission point 128 should be as great as possible. Consequently, the valve mechanism according to the present embodiment has an advantage over the valve mechanism according to the first embodiment (in which the inclination angle of the osculating circle 44 decreases with an increase in the lift) in terms of preventing the bearing section 116 from rising.

More specifically, the components of the force exerted on the maximum force transmission point 128 in the maximum lift state within the valve mechanism according to the present embodiment can be depicted as shown in FIG. 14B. As shown in FIG. 14B, the force exerted on the maximum force transmission point 128 can be regarded as separable into a radial component 130, which is directed toward the center of the pivot 114, and a tangential component 132, which is directed in the direction of further inserting the pivot 114. Consequently, the valve mechanism according to the present embodiment does not permit the bearing section 116 to rise even in the maximum lift state.

As described above, the valve mechanism according to the present embodiment can avoid the rise of the bearing section 116 in all lift regions by providing the pivot 114 with the cut surface 116, which is inclined toward the maximum force transmission point 128 at an angle of α° relative to the axis of the HLA 110. Consequently, the valve mechanism according to the present embodiment can properly prevent the rise of the bearing section 116 while maintaining a sufficiently great maximum lift amount, as is the case with the valve mechanism according to the first embodiment.

Meanwhile, the valve mechanism according to the third embodiment is configured so that the axis of the HLA 110 is parallel to the direction of a straight line connecting the center of the control shaft 24 to the center of the rocker roller 20, that is, the direction of roller pressure force in the zero lift state, as is the case with the valve mechanism according to the first embodiment (therefore, the inclination angle α° of the osculating circle 124 is not only an inclination angle relative to the axis of the HLA 110 but also an inclination angle relative to the direction of roller pressure force in the zero lift state). The use of this configuration makes it possible to sufficiently reduce the changes in the valve opening characteristic, which result from temporal changes, and the difference in the valve opening characteristic between cylinders, as is the case with the first embodiment.

To avoid the rise of the bearing section 116, however, it is not always necessary to make the axis of the HLA 110 parallel to the roller pressure force in the zero lift state. Therefore, if the posture changes of the rocker arm 112, which result from adjustments made by the HLA 110, are ignorable, the HLA 110 may be positioned so that its axis is inclined relative to the roller pressure force in the zero lift state.

Fourth Embodiment

Configuration of Fourth Embodiment

Figure 15:
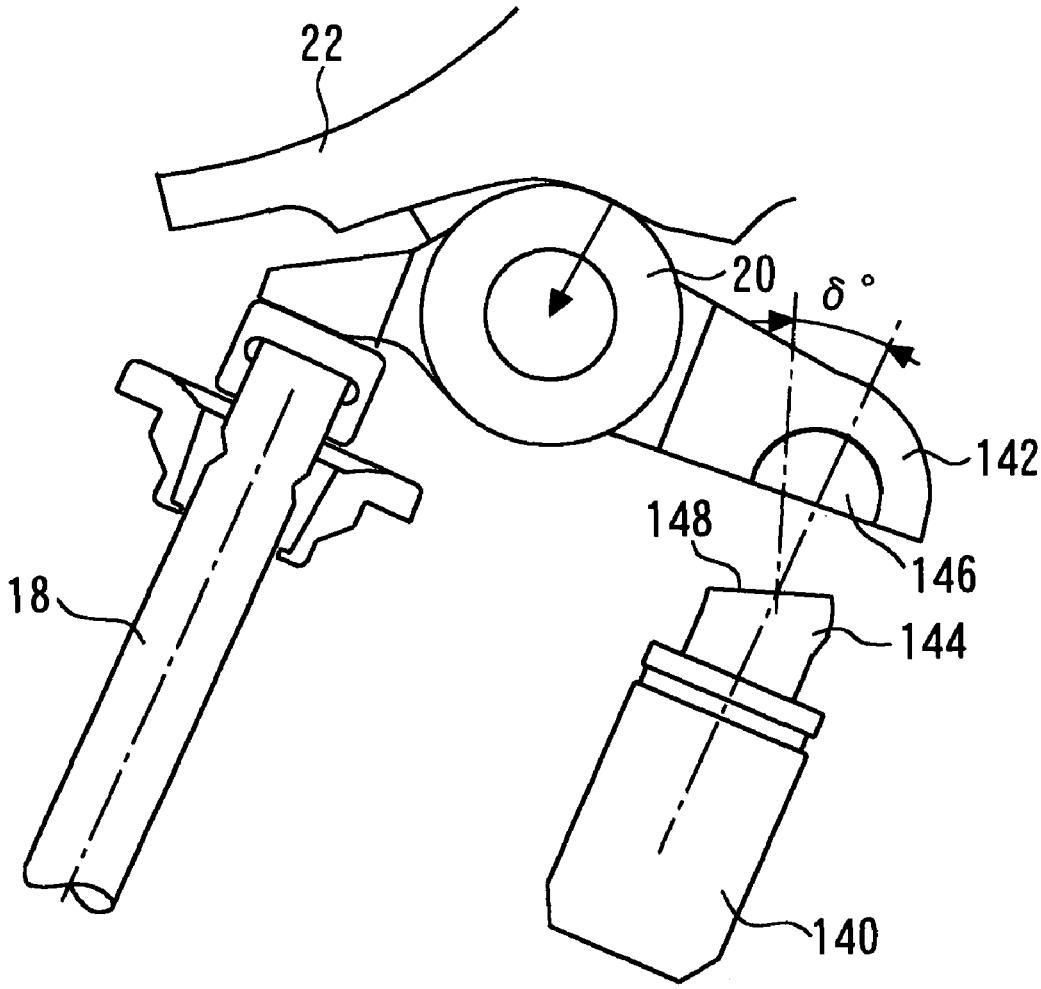
FIG. 15 illustrates a characteristic configuration of valve mechanism according to a fourth embodiment of the present invention.

A fourth embodiment of the present invention will now be described with reference to FIGS. 15 to 17. FIG. 15 is an enlarged view illustrating the HLA 140 and rocker arm 142 that are used in the fourth embodiment of the present invention. The valve mechanism according to the present embodiment is the same as the valve mechanism according to the second embodiment, which has been described earlier, except that the pivot 144 of the HLA 140 and the bearing section 146 of the rocker arm 142 differ in shape from the counterparts used in the second embodiment.

The pivot 144 and bearing section 146 for use in the present embodiment are configured the same as the pivot 114 and bearing section 116 for use in the third embodiment. More specifically, the pivot 144 has a spherically curved surface, which includes a circular cut surface 148. The bearing section 146 is a spherical dent having a larger curvature radius than the spherically curved surface of the pivot 144.

The cut surface 148 of the pivot 144 is configured so that its axis is inclined at an angle of δ° relative to the axis of the HLA 140. Further, the HLA 140 according to the present embodiment is positioned so that the axis of the cut surface 148 is inclined toward the valve disc 18 in relation to the axis of the HLA 140. As a result, an osculating circle is formed between the pivot 144 and bearing section 146, the axis of the osculating circle being inclined toward the valve disc 18 at an angle of δ° relative to the axis of the HLA 140.

Operation of Fourth Embodiment

Figure 16A:
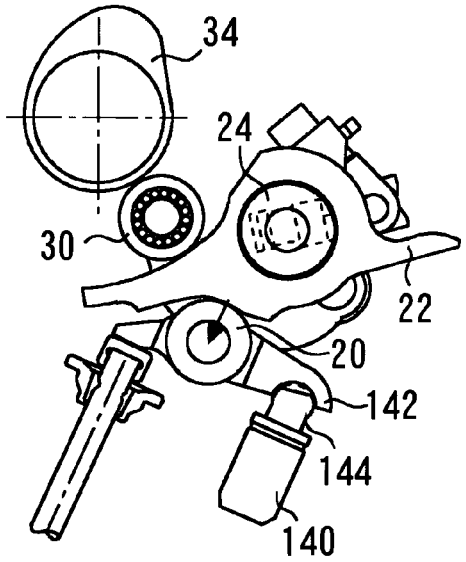
FIGS. 16A and 16B illustrate a configuration in a zero lift state of the valve mechanism according to a fifth embodiment of the present invention.
Figure 16B:
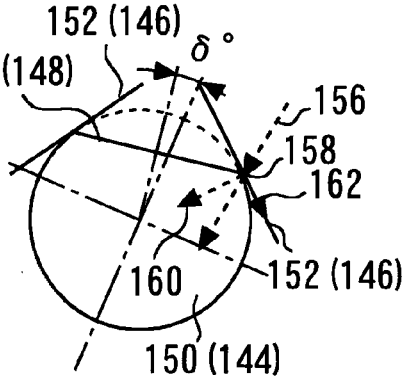
Figure 17A:
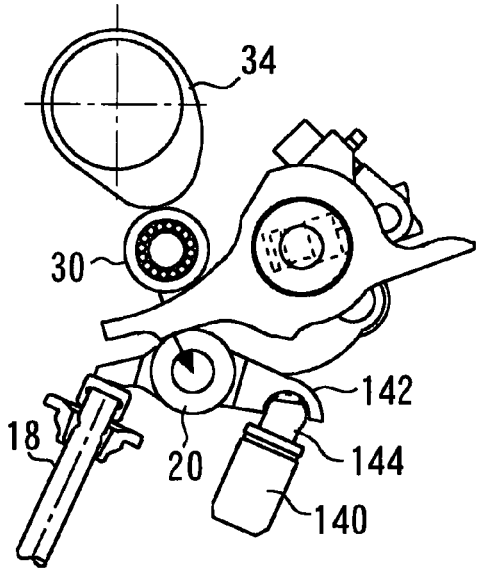
FIGS. 17A and 17B illustrate a configuration in a maximum lift state of the valve mechanism according to a sixth embodiment of the present invention.
Figure 17B:
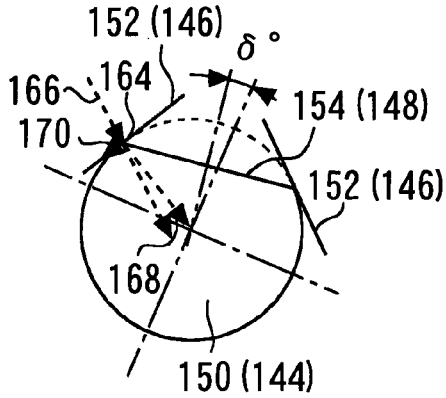

FIGS. 16A, 16B, 17A, and 17B illustrate the operation of the valve mechanism according to the fourth embodiment of the present invention. More specifically, FIGS. 16A and 16B show a zero lift state, whereas FIGS. 17A and 17B show a maximum lift state.

In FIG. 16B, a sphere 150 and a tangent line 152 represent the spherically curved surface of the pivot 144 and the wall surface of the bearing section 146, respectively. An osculating circle 154 represents the outer circumference of the circular cut surface 148. In the valve mechanism according to the present embodiment, the axis of the osculating circle 154 in the zero lift state is inclined toward the valve disc 18 at an angle of δ° relative to the axis of the HLA 14. In this instance, the force 156 transmitted from the bearing section 146 to the pivot 144 is maximized at a point 158 that is closer to the HLA 140 than any other point on the osculating circle 154. The force 156 exerted on this point 158 has a radial component 160, which is directed toward the center of the pivot 144, and a tangential component 162, which is directed in the direction of further inserting the pivot 144. Consequently, the valve mechanism according to the present embodiment does not permit the bearing section 146 to rise in the zero lift state.

In the valve mechanism according to the present embodiment, the inclination angle of the osculating circle 154 remains unchanged without regard to the posture of the rocker arm 142, as is the case with the third embodiment. Therefore, the inclination angle of the osculating circle 154 in relation to the axis of the HLA 140 is maintained at δ° even in the maximum lift state, as shown in FIG. 17B.

In the valve mechanism according to the present embodiment, the contact point at which the rocker roller 30 contacts the swing arm 22 shifts from the base contact point toward the valve disc 18 when the lift of the valve disc 18 increases, as is the case with the second embodiment. In the maximum lift state, therefore, a point 164 positioned closer to the valve disc 18 than any other point on the osculating circle 154 is a point for transmitting the greatest force, that is, a maximum force transmission point 164.

In the valve mechanism according to the present embodiment, the force 166 exerted on the maximum force transmission point 164 can be regarded as separable into a radial component 168, which is directed toward the center of the pivot 144, and a tangential component 170, which is directed in the direction of further inserting the pivot 144, as shown in FIG. 17B. Consequently, the valve mechanism according to the present embodiment does not permit the bearing section 146 to rise even in the maximum lift state.

If the inclination angle of the osculating circle 148 is fixed in relation to the axis of the HLA 140, the greater the lateral component included in the force input to the bearing section 146, the more likely the bearing section 146 will rise. Further, the lateral component input to the bearing section 146 increases with an increase in the lift of the valve disc 18. In the valve mechanism according to the present embodiment, therefore, the maximum lift state is the severest state for avoiding the rise of the bearing section 146.

As described above, the configuration of the present embodiment generates the tangential component 170 in the direction of further inserting the pivot 144 into the bearing section 146 even in the maximum lift state. Therefore, the configuration of the present embodiment can properly prevent the rise of the bearing section 146 in all lift regions.

Meanwhile, the valve mechanism according to the fourth embodiment is configured so that the axis of the valve disc 18 is parallel to the axis of the HLA 140, as is the case with the valve mechanism according to the second embodiment (therefore, the inclination angle δ° of the osculating circle 148 is not only an inclination angle relative to the axis of the HLA 140 but also an inclination angle relative to the axis of the valve disc 18). The use of this configuration can make a cylinder head machining process easy as is the case with the second embodiment.

To avoid the rise of the bearing section 146, however, it is not always necessary to make the axis of the valve disc 18 parallel to the axis of the HLA 140. Therefore, if machining process facilitation is not absolutely demanded, the HLA 14 may be positioned so that its axis is inclined relative to the axis of the valve disc 18.

The invention claimed is:

1. An internal combustion engine valve mechanism comprising:

a rocker arm that has a bearing section at one end and a rocker roller at the center region;

a lash adjuster that has a pivot, which is to be inserted into the bearing section, and supports one end of the rocker arm;

a valve disc that contacts with the other end of the rocker arm; and a transmission member that operates periodically in synchronism with the rotation of a camshaft to periodically press the rocker roller;

wherein the direction of a roller pressure force applied to the rocker roller from the transmission member varies with a lift amount of the valve disc;

wherein the bearing section and the pivot have different curvatures so that the contact between the bearing section and the pivot forms an osculating circle; and wherein an axis of the osculating circle prevailing in a zero lift state is inclined toward a maximum force transmission point, which transmits greater force than any other point on the osculating circle prevailing in a maximum lift state, in relation to an axis of the lash adjuster.

2. The internal combustion engine valve mechanism according to claim 1, wherein the axis of the lash adjuster is parallel to the direction of the roller pressure force in a zero lift state.

3. The internal combustion engine valve mechanism according to claim 1, wherein the axis of the lash adjuster is parallel to the axis of the valve disc.

4. The internal combustion engine valve mechanism according to claim 1, wherein the pivot has a spherically curved surface that is in contact with the bearing section; and wherein the bearing section is a shell-shaped dent having a curved surface that is in contact with the pivot and has a larger curvature radius than the spherically curved surface, the axis of the bearing section having an inclination that should be satisfied by the axis of the osculating circle.

5. The internal combustion engine valve mechanism according to claim 4, wherein the transmission member is configured so that the contact position between the transmission member and the rocker roller moves on the rocker roller toward the lash adjuster as the lift amount of the valve disc increases; and wherein the inclination of the osculating circle is set so that the force transmitted from the bearing section to the pivot at the maximum force transmission point in a maximum lift state is directed toward a main body of the lash adjuster in relation to the center of the spherically curved surface.

6. The internal combustion engine valve mechanism according to claim 4, wherein the transmission member is configured so that the contact position between the transmission member and the rocker roller moves on the rocker roller toward the valve disc as the lift amount of the valve disc increases; and wherein the inclination of the osculating circle is set so that the force applied in a zero lift state to a maximum force transmission point, which transmits greater force than any other point on the osculating circle prevailing in a zero lift state, is directed toward a main body of the lash adjuster in relation to the center of the spherically curved surface.

7. The internal combustion engine valve mechanism according to claim 1, wherein the bearing section is a dent having a spherically curved surface that is in contact with the pivot; and wherein the pivot has, at a section for insertion into the bearing section, a shape that is obtained by circularly cutting a part of a spherically curved surface having a smaller curvature radius than the spherically curved surface of the bearing section, an axis of a circularly cut portion having an inclination that should be satisfied by the axis of the osculating circle.

8. The internal combustion engine valve mechanism according to claim 7, wherein the inclination of the circularly cut portion is set so that the force transmitted from the bearing section to the pivot at the maximum force transmission point in a maximum lift state is directed toward a main body of the lash adjuster in relation to the center of the spherically curved surface.

9. The internal combustion engine valve mechanism according to claim 1, further comprising:

a control shaft that functions as a rotation center shaft of the transmission member;

a base rotation position change mechanism for changing a base rotation position of the transmission member in a zero lift state in accordance with the position of the control shaft; and a cam operation conversion mechanism for converting the motion of a cam included in the camshaft to a swing of the transmission member, which begins at the base rotation position;

wherein a line connecting the center of the control shaft to the center of the rocker roller is parallel to the axis of the lash adjuster.

10. An internal combustion engine valve mechanism comprising:

a rocker arm that has a bearing section at one end and a rocker roller at the center;

a lash adjuster that has a pivot, which is to be inserted into the bearing section, and supports one end of the rocker arm;

a valve disc that contacts with the other end of the rocker arm; and a transmission member that operates periodically in synchronism with the rotation of a camshaft to periodically press the rocker roller;

wherein the direction of a roller pressure force applied to the rocker roller from the transmission member varies with a lift amount of the valve disc;

wherein the bearing section and the pivot have different curvatures so that the contact between the bearing section and the pivot forms an osculating circle; and wherein an axis of the osculating circle prevailing in a zero lift state is inclined toward a maximum force transmission point, which transmits greater force than any other point on the osculating circle prevailing in a maximum lift state, in relation to a direction of the roller pressure force in the zero lift state.

11. An internal combustion engine valve mechanism comprising:

a rocker arm that has a bearing section at one end and a rocker roller at the center;

a lash adjuster that has a pivot, which is to be inserted into the bearing section, and supports one end of the rocker arm;

a valve disc that contacts with the other end of the rocker arm; and a transmission member that operates periodically in synchronism with the rotation of a camshaft to periodically press the rocker roller;

wherein the direction of a roller pressure force applied to the rocker roller from the transmission member varies with a lift amount of the valve disc;

wherein the bearing section and the pivot have different curvatures so that the contact between the bearing section and the pivot forms an osculating circle; and wherein an axis of the osculating circle prevailing in a zero lift state is inclined toward a maximum force transmission point, which transmits greater force than any other point on the osculating circle prevailing in a maximum lift state, in relation to an axis of the valve disc.

12. The internal combustion engine valve mechanism according to claim 11, wherein the axis of the lash adjuster is parallel to the direction of the roller pressure force in a zero lift state.

13. The internal combustion engine valve mechanism according to claim 11, wherein the axis of the lash adjuster is parallel to the axis of the valve disc.

14. The internal combustion engine valve mechanism according to claim 11, wherein the pivot has a spherically curved surface that is in contact with the bearing section; and wherein the bearing section is a shell-shaped dent having a curved surface that is in contact with the pivot and has a larger curvature radius than the spherically curved surface, the axis of the bearing section having an inclination that should be satisfied by the axis of the osculating circle.

15. The internal combustion engine valve mechanism according to claim 14, wherein the transmission member is configured so that the contact position between the transmission member and the rocker roller moves on the rocker roller toward the lash adjuster as the lift amount of the valve disc increases; and wherein the inclination of the osculating circle is set so that the force transmitted from the bearing section to the pivot at the maximum force transmission point in a maximum lift state is directed toward a main body of the lash adjuster in relation to the center of the spherically curved surface.

16. The internal combustion engine valve mechanism according to claim 14, wherein the transmission member is configured so that the contact position between the transmission member and the rocker roller moves on the rocker roller toward the valve disc as the lift amount of the valve disc increases; and wherein the inclination of the osculating circle is set so that the force applied in a zero lift state to a maximum force transmission point, which transmits greater force than any other point on the osculating circle prevailing in a zero lift state, is directed toward a main body of the lash adjuster in relation to the center of the spherically curved surface.

17. The internal combustion engine valve mechanism according to claim 11, wherein the bearing section is a dent having a spherically curved surface that is in contact with the pivot; and wherein the pivot has, at a section for insertion into the bearing section, a shape that is obtained by circularly cutting a part of a spherically curved surface having a smaller curvature radius than the spherically curved surface of the bearing section, an axis of a circularly cut portion having an inclination that should be satisfied by the axis of the osculating circle.

18. The internal combustion engine valve mechanism according to claim 17, wherein the inclination of the circularly cut portion is set so that the force transmitted from the bearing section to the pivot at the maximum force transmission point in a maximum lift state is directed toward a main body of the lash adjuster in relation to the center of the spherically curved surface.

19. The internal combustion engine valve mechanism according to claim 11, further comprising:

a control shaft that functions as a rotation center shaft of the transmission member;

a base rotation position change mechanism for changing a base rotation position of the transmission member in a zero lift state in accordance with the position of the control shaft; and a cam operation conversion mechanism for converting the motion of a cam included in the camshaft to a swing of the transmission member, which begins at the base rotation position;

wherein a line connecting the center of the control shaft to the center of the rocker roller is parallel to the axis of the lash adjuster.

* * * * *